US006491323B1

(12) United States Patent
Kustritz

(10) Patent No.: US 6,491,323 B1
(45) Date of Patent: Dec. 10, 2002

(54) SKI POLE HANDLE ASSEMBLY

(76) Inventor: James Kustritz, 8409 Sumter Ave. North, Brooklyn Park, MN (US) 55445

( * ) Notice: Subject to any disclaimer, the term of this patent is extended or adjusted under 35 U.S.C. 154(b) by 0 days.

(21) Appl. No.: 09/502,267

(22) Filed: Feb. 11, 2000

(51) Int. Cl.[7] ..... A63C 11/22
(52) U.S. Cl. ..... 280/821; 280/822; 280/824
(58) Field of Search ..... 280/816, 819, 280/821, 822, 823; 135/66, 74, 75, 76, 25.4; 16/325, 335, 445, 429

(56) References Cited

U.S. PATENT DOCUMENTS

| | | | | | |
|---|---|---|---|---|---|
| 3,797,845 | A | * | 3/1974 | Kepka et al. | 280/822 |
| 4,062,554 | A | | 12/1977 | Korger | |
| 4,172,601 | A | * | 10/1979 | Hutter | 280/816 |
| 4,232,875 | A | | 11/1980 | Klees | |
| 4,244,602 | A | * | 1/1981 | Allsop et al. | 280/821 |
| 4,402,529 | A | * | 9/1983 | Cavazza | 280/816 |
| 4,508,364 | A | * | 4/1985 | Joseph | 280/821 |
| 4,597,589 | A | | 7/1986 | Fujii et al. | |
| 4,775,168 | A | * | 10/1988 | Dalebout | 280/821 |
| 5,484,361 | A | * | 1/1996 | Dunn | 280/821 |
| 6,082,767 | A | * | 7/2000 | Bujold et al. | 280/819 |
| 6,142,527 | A | * | 10/2000 | Lenhart | 280/823 |

FOREIGN PATENT DOCUMENTS

| | | |
|---|---|---|
| CH | 562 041 | 5/1975 |

* cited by examiner

*Primary Examiner*—Brian L. Johnson
*Assistant Examiner*—Hau Phan
(74) *Attorney, Agent, or Firm*—Nawrocki, Rooney & Sivertson, P.A.

(57) ABSTRACT

A ski pole handle assembly having an elongated body adapted to axially engage an upper portion of a ski pole wherein the upper portion of the ski pole is substantially aligned with a shaft of the ski pole, a hand grip pivotable between pull and push poling stroke positions, and a hand grip return mechanism for urging said hand grip from the push position to the pull position of a poling stroke is provided. The hand grip has upper and lower end portions, the upper end portion being pivotably connected to a free end of the elongated body.

10 Claims, 4 Drawing Sheets

SKI POLE HANDLE ASSEMBLY

TECHNICAL FIELD

The present invention relates to a ski pole handle assembly, and more particularly to a ski pole handle assembly having an hand grip pivotable between the pull and push positions associated with a poling stroke so as to increase stroke power while likewise conserving energy.

BACKGROUND OF INVENTION

The essence of skiing involves gliding across the snow. As much as we associate skiing with gently rolling hills or steep slopes, an important component of skiing involves self-propulsion, namely the use of synchronous arm and leg movement to initiate and maintain forward motion from an at rest position. This is particularly the case with cross-country skiing, and to a lesser extent with downhill skiing, where the aim is to rhythmically glide on alternating skis in combination with an opposite arm poling motion.

The fundamental cross country skiing motion is that of the diagonal stride—the use of a driving motion with the hips in a straight-ahead direction. As a matter of efficiency, the diagonal stride is combined with arm poling to enhance gliding. As with any dynamic mechanical system, increased power and energy conservation are sought after commodities.

An essential power technique for self-propulsion is known as "double poling." The double pole motion involves reaching ahead with both arms and poling with both arms while keeping the legs in a relaxed, but relatively straight position. To add power and conserve energy, the torso is bent slightly forward at the waist while compressing the abdominal muscles. With this technique, the entire propulsive force results from bending at the trunk and pulling/pushing with the arms.

A variation of the basic double poling technique includes the addition of "kick" (i.e., addition of a small drive forward onto one leg during the "reach forward" of the double pole). The motion is also combinable with other known techniques such as the basic "V-skate." In what is referred to as the "V2 alternate" or "open field skate," a skier uses a double pole arm motion on one side of a V-skate, and an arm recovery swing on the other side (i.e., the skier pushes on one side with the upper body and glides on the other side).

With body dynamics well established, mechanical advantage vis-a-vis equipment design has been a focus. Previous ski poles incorporated a handle fixed to the rigid shaft of the pole and shaped to fit the hand. Since the handle is rigidly incorporated into the body of the pole, the hand must partially release its grip during normal skiing, due to the limited range of motion of the joints of the hand and arm. A strap is generally fixed to the uppermost part of the pole, through which the hand is placed, which allows the hand to partially release the pole midway through the rearward thrust of the pole before the succeeding thrust. Previous handle and strap designs have allowed for greater control over the pole while increasing support of the hand and wrist.

U.S. Pat. No. 4,597,589, issued to Fujii et al., shows a ski pole grip which centrally pivots atop of the shaft of a ski pole to allow use of the grip in either a vertical or horizontal position. The entire grip is convertible on the shaft, without a change in hand position, from an in-line position where the grip is in axially alignment with the shaft, to a transverse position atop the shaft of the ski pole. When the grip is in the horizontal position so as to form a tee-handled pull pole, a power stroke resembling that used in rowing is contemplated, as when lunging from an at rest position, for instance from a starting gate as in downhill skiing. No mechanical advantage is gained using this design during the continuous poling motion widely associated with nordic skiing. Furthermore, this convertible grip is intended to be used either the in-line or transverse grip position, not during the pivoting motion during conversion from one mode to the other.

Swiss Patent No. 562,041 shows various forms of a ski pole handle having pivotable components. In FIGS. 2 through 4, a handle having two longitudinal halves is shown atop a conventional ski pole. A forward half is fixed to the shaft of a ski pole, with its upper end adapted to receive a rearward half of the handle for pivot motion with respect to the shaft. In FIGS. 5 through 8, a pivotable hand grip is shown suspended from a 90 degree bend at the end of a ski pole. The lowermost portion of the grip is tethered to the pole by a spring housed in the grip (i.e., the spring links the lowermost portion of the grip to a tensioning knob integral to the pole). Although the handle style of FIGS. 5 through 8 may offer some mechanical advantage during poling, the general configuration of the components, namely the bend in the pole and the grip depending therefrom, is such that the poling or stroking forces are distributed quite differently from those in a conventional pole arrangement, such as that shown in FIGS. 2 through 4, thereby detracting from mechanical advantage. Furthermore, this configuration is awkward to operate, with the grip having a limited range of pivot motion, the entire assembly requires a specially configured ski pole, and the return mechanism is exposed (i.e., unprotected) through the pulling stroke.

None of the heretofore known designs permit the hand to firmly grasp a handle with all parts of the hand in engagement therewith throughout the entire range of poling motion, while pushing backwards on the planted pole through a full range of arm motion, so as to deliver a snap of the wrist efficiently to and through the pole for an enhanced power stroke. Heretofore known grips limit the quantum and duration of force which can be applied during a rearward thrust of the poles during the essential poling motion.

SUGARY OF THE INVENTION

A ski pole handle assembly having an elongated body adapted to axially engage an upper portion of a ski pole wherein the upper portion of the ski pole is substantially aligned with a shaft of the ski pole, a hand grip pivotable between pull and push poling stroke positions, and a hand grip return mechanism for urging said hand grip from the push position to the pull position of a poling stroke is provided. The hand grip has upper and lower end portions, the upper end portion being pivotably connected to a free end of the elongated body.

More specific features and advantages will become apparent with reference to the DETAILED DESCRIPTION OF THE INVENTION, appended claims, and the accompanying drawing figures.

DETAILED DESCRIPTION OF THE INVENTION

Figure 1:
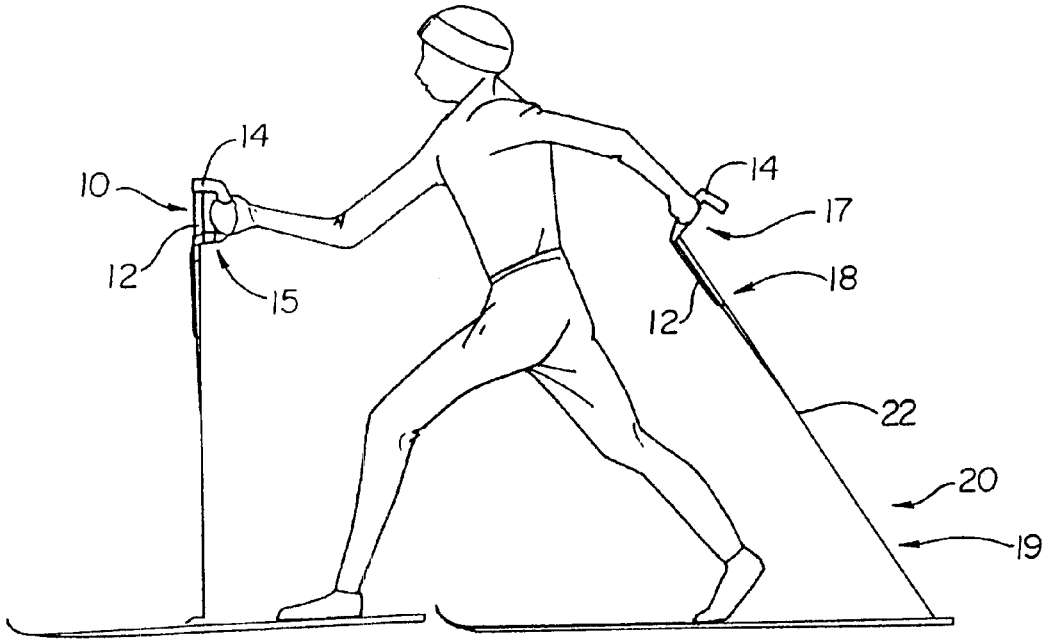
FIG. 1 shows a cross-country skier using ski poles equipped with the handle assemblies of the subject invention, particularly illustrating the energy efficient power stroke obtainable therewith.

Referring to FIG. 1, a cross-country skier is shown in "freeze frame", during a gliding stroke. The skier's right arm and left leg are extended forward, in anticipation of a forward thrust generated by a combination of the right leg "kick" and the left arm power stroke. As shown, the right arm is positioned for pulling, whereas the left arm is positioned for pushing. The ski pole handle assembly 10 of the subject invention generally includes an elongated body 12, a pivotable hand grip 14, and a mechanism 16 that permits the hand grip 14 to tensioningly pivot between "closed" 15 (i.e., the condition depicted in the skier's right hand, otherwise known as the "pull" position) and "open" 17 (i.e., the condition depicted in the skier's left hand, otherwise known as the "push" position) positions. This assembly 10 permits arm motion through its full range of poling in an energy efficient manner, and particularly enables a wrist snap during the push stroke for increased power transfer and delivery.

Figure 2:
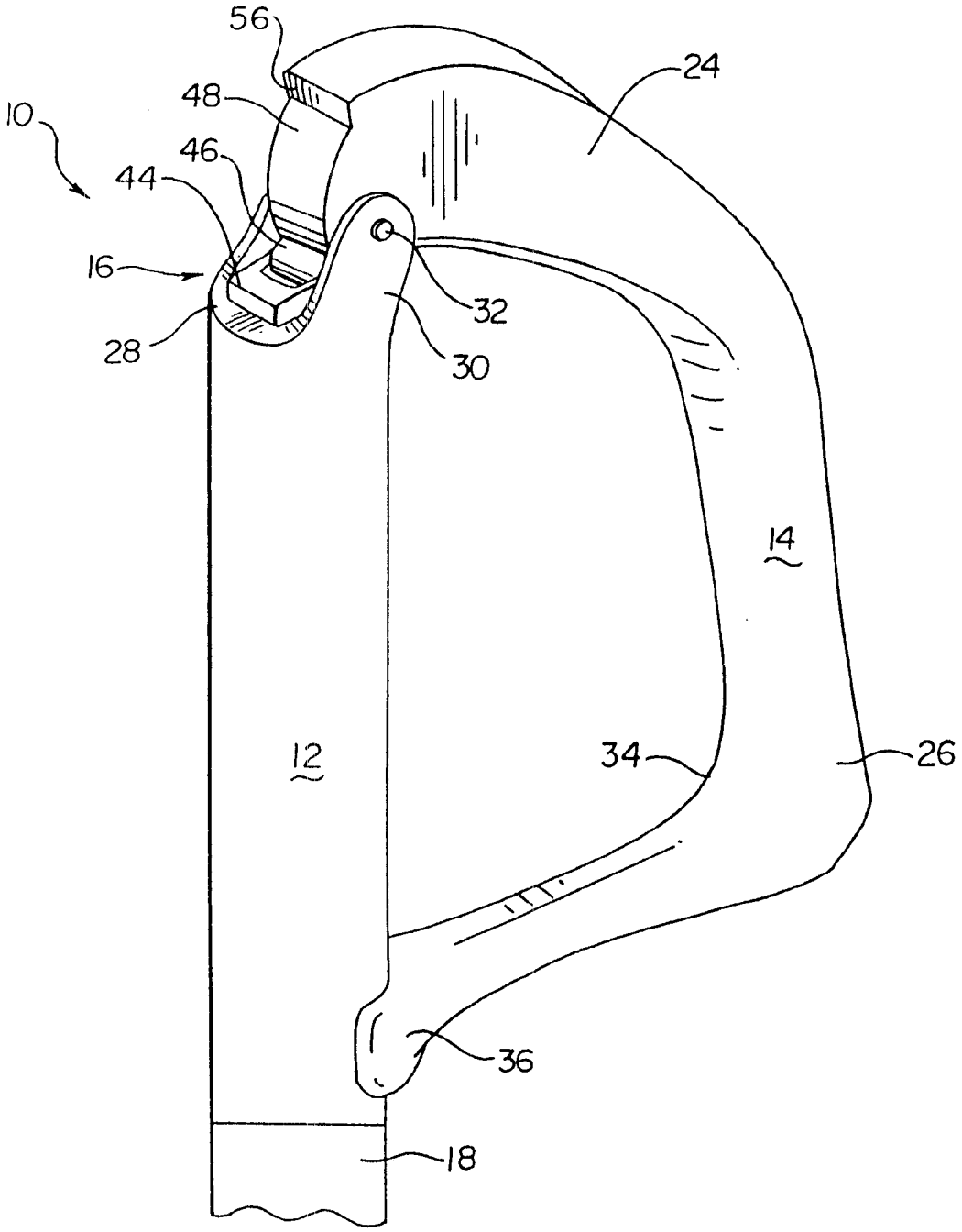
FIG. 2 is a perspective view of the ski pole handle assembly.

Referring now to FIG. 2, the elongated body 12 of the assembly 10 is adapted to axially engage an upper portion 18 of a ski pole 20 which is substantially aligned (i.e., in alignment) with a shaft 22 of the ski pole 20. The body 12 of the assembly 10 is intended to cooperate with the shaft or tubular shank 22 of a "conventional" ski pole 20 (i.e., one that is substantially linear, or at least possessing linearly extending upper 18 and lower 19 end portions, as shown in FIG. 1). Furthermore, the body 12 of the assembly 10 may be an integral or "built-in" component of a conventional ski pole 20 without deviating in scope or spirit from the subject assembly.

The hand grip 14 of the assembly 10 is pivotable between the pull 17 and push 19 positions of the poling stroke, and may be fairly said to visually resemble a mug handle. The hand grip 14 has upper 24 and lower 26 end portions, with the upper end portion 24 being pivotably connected to a free end 28 of the elongated body 12. This connection may be achieved in a variety of known ways, as for example by registration of an aperture in the upper end portion 24 of the hand grip 14 with apertured opposing flanges 30 which vertically extend from the body 12 of the assembly 10, and securing same with a pivot pin 32 or the like. The hand grip 14 may optionally be equipped with known styles of retention (i.e., wrist) straps (not shown), whether they be flexible, as the case with traditional leather straps, or semi-rigid, as is the case with molded plastic "loops" and the like.

The lower end portion 26 of the hand grip 14 preferable includes a crotch 34, formed by a bend or more generally by a change in direction of a segment of the lower end portion 26 of the hand grip 14, against which a portion of a skier's hand rests. The lower end portion 26 of the assembly 10 is adapted to be reversibly latchable to either the elongated body 12 of the assembly 10, or the upper portion 18 of a ski pole 20 adjacent the body 12. Although alternate adaptations are contemplated, a spring type clip 36 is shown in the figures (see especially FIG. 4). The nature of the spring clip 36 is such that its ability to latch is overcome during the transition from a pole plant (i.e., pull) to a pole push. A detailed review of the principles of operation of the handle assembly 10 accompany a later discussion of FIGS. 3 & 5.

Figure 3:
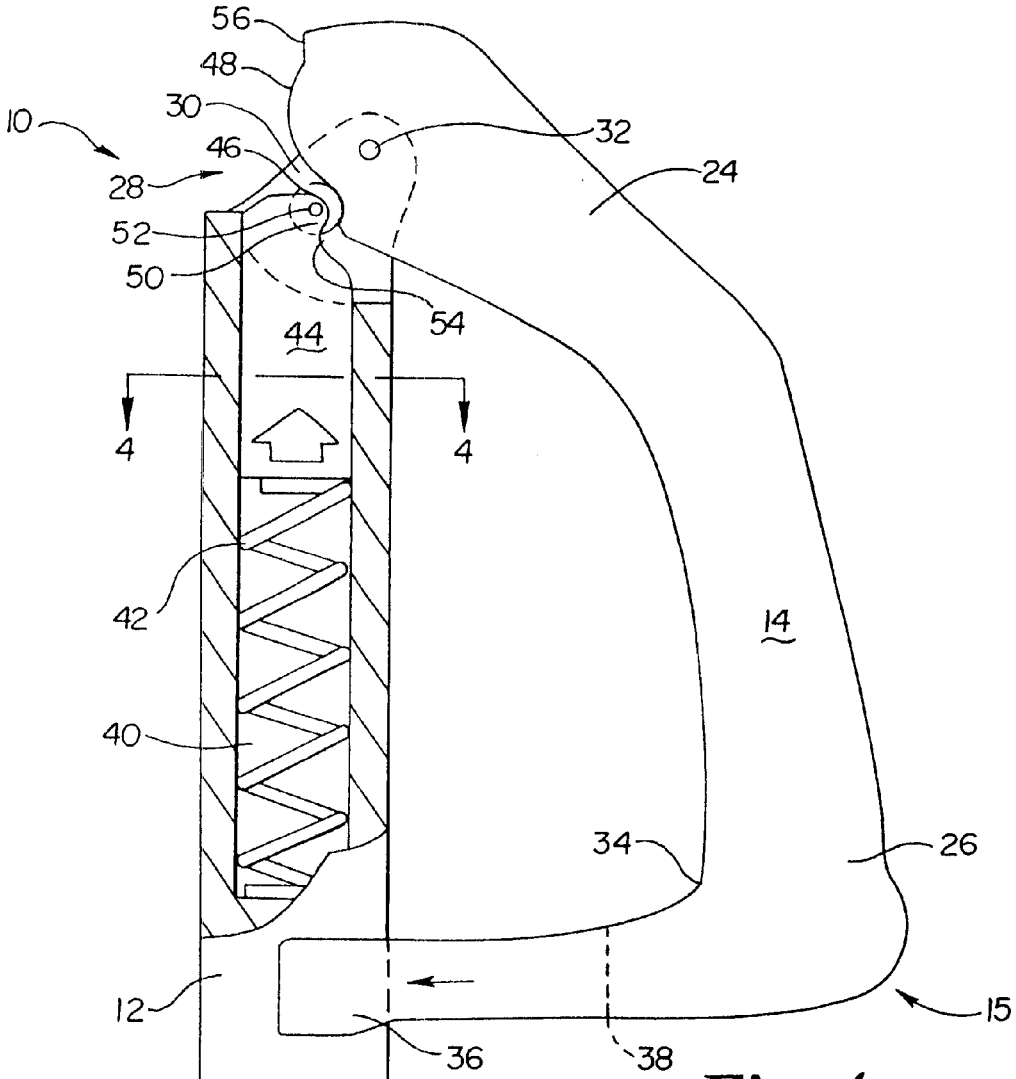
FIG. 3 is an elevation view of the ski pole handle assembly, with exterior portions broken away to show underlying detail.

The lower end portion 26 of the hand grip 14 alternately may further include a free end 38 (shown by the broken line in FIG. 3). The free end 38 is preferable configured to maximize retention of a skier's hand upon the hand grip 14, as by bending to form a crotch as shown, providing a knob or other prominent feature at the terminal end thereof, etc. In this style, the lower end portion 26 of the hand grip 14 does not cooperatively engage either the elongated body 12 or the ski pole shaft 22.

Figure 4:
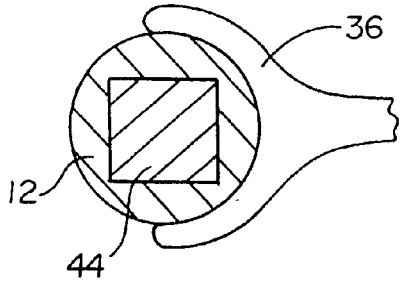
FIG. 4 is a sectional view taken along line 4—4 of FIG. 3.
Figure 5:
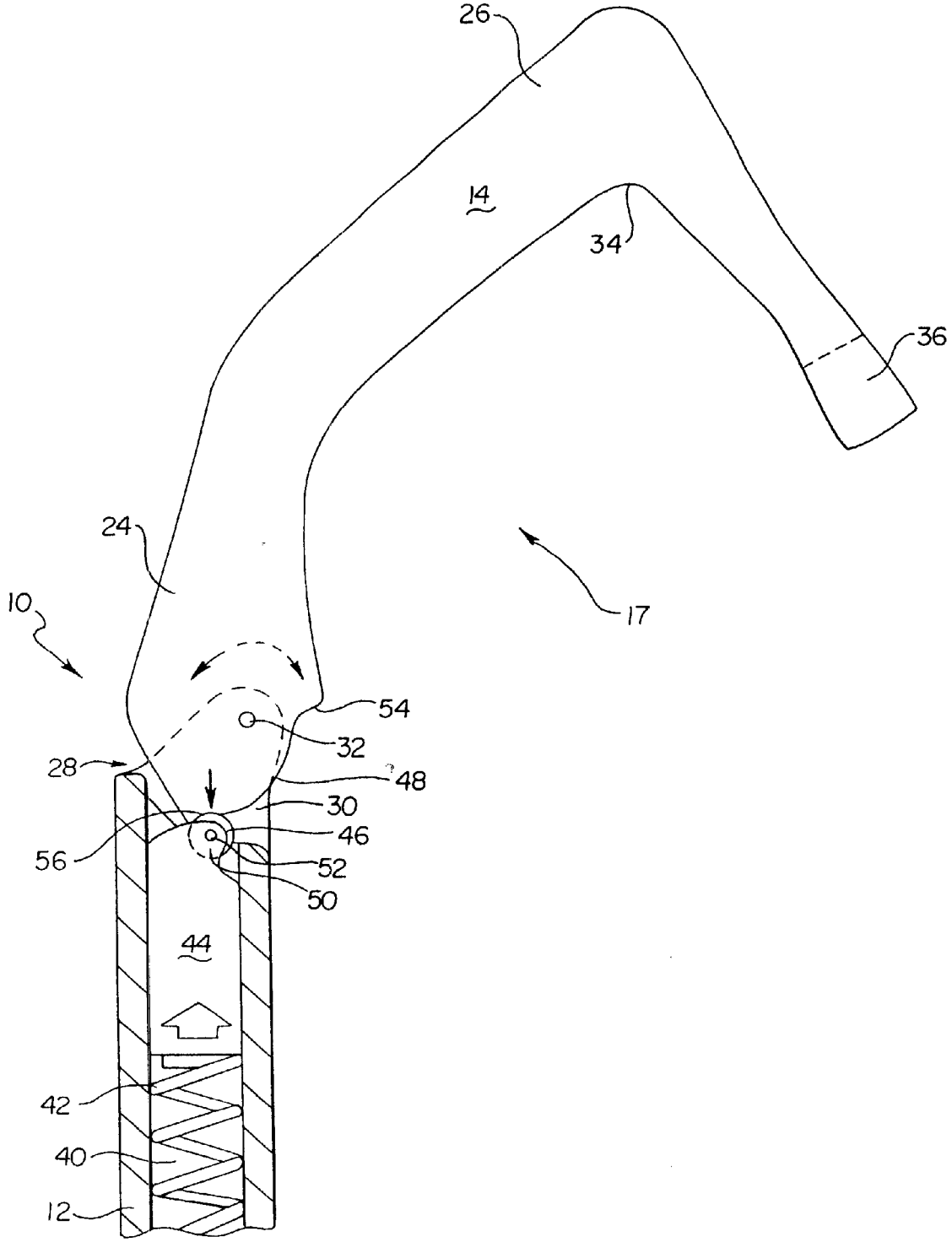
FIG. 5 is an elevation view of the ski pole handle assembly, with exterior portions broken away to show underlying detail, particularly illustrating the hand grip positioned for a power stroke.

Referring now to FIGS. 3 & 5, a hand grip return mechanism 16 is provided to resist the pivot motion of the hand grip 14 between the pull 15 and push 17 positions. The return mechanism 16, which ultimately urges the hand grip 14 from the push 17 position of FIG. 5 to the pull 15 position of FIG. 3, is housed within the elongated body 12 of the assembly 10, namely within cavity 40. This construction provides a neat and clean appearance for the upper portion 18 of the ski pole 20. As shown in FIG. 4, the cavity 40 preferably has square cross section, or more generally an angular cross section. This provides stability and generally enhances the structural integrity of the return mechanism 16 and the body 12 of the assembly 10.

The return mechanism 16 includes a spring 42 and a plunger 44 disposed between the spring 42 and the upper end portion 24 of the hand grip 14. The plunger 44, which is floatlingly supported on the spring 42, is vertically displaceable within the body cavity 40 by pivoting of the hand grip 14 about the pivot pin 32. The plunger 44 is equipped with a roller 46 for low friction contact (i.e., rolling engagement) with a camming surface 48 of the upper end portion 24 of the hand grip 14 (see also FIG. 2). The roller 46, as illustrated, is carried on laterally extending plunger flanges 50 by a shaft, pin or the like 52.

The camming surface 48 may have a uniform radius cam as measured from the pivot point 32 of the hand grip 14, however, the camming surface 48 preferably has an increasing radius cam in the direction of pivot motion (i.e., the radius increase when pivoting from a pull 15 to a push 17 position). The camming surface 48 of the upper end portion 24 of the hand grip 14 is delimited by pull 54 and push 56 travel stops which limit pivoting travel (i.e., the "range" of pivot motion) of the hand grip 14 about the pivot point 32. The travel stops 54 & 56 are preferably integral to the upper end portion 24 of the hand grip 14, that is to say that the portion of the upper handle surface engageable with the return mechanism 16 includes a contour capable of resisting travel of the roller 46 thereagainst. Although a surface contour is preferred to delimit a range of pivot motion for the hand grip 14 of the handle assembly 10, such travel stops 54 & 56 need not be in this form.

As opposed to the pull travel stop 54 which is complemented by the function of the spring clip 36 at the lower end portion 26 of the hand grip 14, the push travel stop 56 functions alone to limit the rearward swing of the hand grip 14. The preferred range of the pivot motion of the hand grip 14 is up to about at least 105 degrees, as this is about the limit of effective and efficient power pushing during the follow through of a polling stroke.

As to the materials of construction of the handle assembly components, durability, wearability, strength and weight are of primary importance, with known plastics, metals and combinations thereof suitable.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A ski pole handle assembly comprising:

(a) an elongated body adapted to axially engage an upper portion of a ski pole wherein the upper portion of the ski pole is substantially aligned with a shaft of the ski pole;

(b) a hand grip pivotable between pull and push positions, said hand grip having upper and lower end portions, said upper end portion being pivotably connected to a free end of said elongated body;

(c) a hand grip return mechanism for urging said hand grip from said push position to said pull position; and, (d) means for resisting the pivot motion of said hand grip between said pull and push positions, said means comprising a spring housed within a cavity of said elongated body, and a plunger disposed between said spring and said upper end portion of said hand grip for displacement within said cavity by the pivoting of said hand grip from said pull position.

2. The assembly of claim 1 wherein said cavity of said elongated body has an angular cross section.

3. The assembly of claim 1 wherein said plunger is equipped with a roller for rolling engagement with a camming surface of said upper end portion of said hand grip.

4. The assembly of claim 3 wherein said camming surface includes means for limiting the pivoting travel of said hand grip about a pivot point.

5. The assembly of claim 4 wherein said means for limiting the pivoting travel of said hand grip about a pivot point comprises at least one roller catching ridge.

6. The assembly of claim 3 wherein said camming surface has a uniform radius cam relative to the pivot point of said hand grip.

7. The assembly of claim 3 wherein said camming surface has an increasing radius cam relative to the pivot point of said hand grip.

8. A ski pole handle assembly comprising:

(a) an elongated body adapted to axially engage an upper portion of a ski pole;

(b) a hand grip pivotable between pull and push positions, said hand grip having upper and lower end portions, said upper end portion being pivotably connected to a free end of said elongated body; and, (c) a hand grip return mechanism for urging said hand grip from said push position to said pull position, said mechanism housed within said elongated body and comprising a spring, and a plunger disposed between said spring and said upper end portion of said hand grip for displacement within a cavity by the pivoting of said hand grip from said pull position.

9. The assembly of claim 8 wherein said plunger is equipped with a roller for rolling engagement with a camming surface of said upper end portion of said hand grip.

10. The assembly of claim 9 wherein said camming surface includes means for limiting the pivoting travel of said hand grip about a pivot point.

* * * * *